United States Patent [19]

Tomasetti et al.

[11] Patent Number: 5,061,875

[45] Date of Patent: Oct. 29, 1991

[54] FOCUS ELECTRODE FOR ELONGATED HEXAGONAL PHOTOMULTIPLIER TUBE

[75] Inventors: Charles M. Tomasetti, Leola; Benjamin W. Narehood, Lititz; Donald B. Kaiser, Lancaster, all of Pa.

[73] Assignee: Burle Technologies, Inc., Wilmington, Del.

[21] Appl. No.: 540,834

[22] Filed: Jun. 20, 1990

[51] Int. Cl.[5] ..... H01J 43/18

[52] U.S. Cl. ..... 313/533; 313/536; 313/537

[58] Field of Search ..... 313/532, 533, 536, 537

[56] References Cited

U.S. PATENT DOCUMENTS

| | | | |
|---|---|---|---|
| 2,678,400 | 5/1954 | McKay | 313/532 |
| 2,908,840 | 10/1959 | Anderson | 313/536 |
| 2,913,610 | 11/1959 | Henderson | 313/532 |
| 4,079,282 | 3/1978 | Faulkner | 313/532 |
| 4,112,325 | 9/1978 | Faulkner | 313/532 |
| 4,570,102 | 2/1986 | McDonie et al. | 313/533 |
| 4,855,642 | 8/1989 | Helvy et al. | 313/532 |
| 4,881,008 | 11/1989 | Kyushima et al. | 313/533 |

FOREIGN PATENT DOCUMENTS

| | | | |
|---|---|---|---|
| 0120379 | 12/1947 | Sweden | 313/536 |

*Primary Examiner*—Donald J. Yusko
*Assistant Examiner*—Ashok Patel
*Attorney, Agent, or Firm*—Martin Fruitman

[57] ABSTRACT

A focus electrode for an elongated hexagonal faceplate photomultiplier tube. The elongated hexagonal face plate and an off-center cage assembly are made to function properly in a photomultiplier tube by the use of a uniquely shaped asymmetric focus electrode. The focus electrode has a base which is a partial circle with two parallel chords and is constructed with a side wall around the perimeter of the base. The side wall has different heights above the two parallel chords of the base and slopes down to minimum but equal heights at points on the curved perimeter which are approximately at the center plane of the tube.

10 Claims, 1 Drawing Sheet

FOCUS ELECTRODE FOR ELONGATED HEXAGONAL PHOTOMULTIPLIER TUBE

SUMMARY OF THE INVENTION

This invention deals generally with discharge devices and more specifically with a focus electrode structure for a plural dynode photomultiplier tube.

Photomultiplier tubes have become commonly used instruments for detecting low light levels. Typically they consist of a glass envelope with an electron emitting photocathode located on the inside surface of a faceplate on the envelope. When light strikes the photocathode, electrons emitted from it are directed toward and collected by an electron multipler. The electron multiplier consists of several secondary electron emitting dynodes, the first of which receives the electrons from the photocathode. The electron multiplier has an electrical output which is directly related to the quantity of electrons collected by the first dynode.

In order to maximize the collection efficiency of a tube, that is, to increase the ratio of electrons collected by the first dynode relative to the number emitted from the photocathode, focus electrodes are located between the photocathode and the first dynode. These electrodes are operated at various electrical potentials to create an electrical field between the photocathode and the first dynode. The ideal electrical field would direct and deliver all the emitted electrons to the first dynode.

The typical photomultiplier tube has a circular face plate, and therefore the electrical focusing field, which is referred to as the electron optics of the tube because it focuses electrons as an optical system focuses light, has always been symmetrical around the central axis of the tube. Such symmetrical fields have been produced by focus electrodes which have also been constructed to be symmetrical about the tube axis. However, circular face plate photomultiplier tubes are simply not satisfactory for some applications.

One such application is scintillation counting in radiation monitoring or study systems. In such a system, a scintillation device, a planar device which produces a point of light where a nuclear particle impacts upon it, is located in close proximity to the faceplates of a group of photomultiplier tubes which then produce electrical signals corresponding to the number and location of the points of light produced by the scintillation device.

For such a system to best fulfill its purpose, the group of photomultiplier tubes should cover as much of the area of the scintillation device's plane as is possible, and circular faceplates are clearly unsatisfactory because their circumferences leave large gaps in the planar field when they are laid out adjacent to each other. While rectangular faceplate configurations would obviously solve this problem by permitting each tube to fit tightly against the adjacent tubes, other constraints on the system, essentially involved in the boundary configuration of the scintillation field, have determined that the most satisfactory faceplate configuration for scintillation counting applications should be an elongated hexagonal shape when used in conjunction with a field of regular hexagonal faceplates.

Unfortunately, however, an elongated hexagonal faceplate on a photomultiplier tube puts extreme constraints on the internal structure of the photomultiplier tube because it requires an asymmetrical focusing field, and to further aggravate the problem, the scintillation counting application requires such small tubes that the first dynode structure must be located off the tube's central axis just to permit the entire structure to be included within the tube. An elongated hexagonal faceplate tube therefore will not function with the conventional focus electrodes of the prior art.

The present invention is a focus electrode of a unique configuration that produces an electrical focusing field which functions particularly well with an elongated hexagonal faceplate photomultiplier tube which has an off-center first dynode.

This focus electrode is essentially a cup with a flat base and sides of varying heights. The base, which is the side of the focus electrode nearest the first dynode, is a partial circle made by using two parallel chords to modify a full circle by cutting off portions of the circle. The base also has a rectangular aperture located off-center with its sides parallel to the limiting chords. This aperture is the means by which the electrons from the photocathode pass through the focus electrode to the first dynode which is located on the other side of the base of the focus electrode and immediately adjacent to it.

The side wall of the focus electrode is attached to the base all around the perimeter of the base, is essentially continuous, and is of a particularly unique configuration. The side wall has two sections attached at the parallel chords of the base each of which has the same height all along its chord, but the side wall section which is closer to the side of the offset aperture in the base is higher than the side wall section on the other chord. The height of the side wall then gradually decreases as it goes around the base from the heights at the end of each chord section to minimum equal heights at locations approximately at the center plane of the tube.

This asymmetrical focus electrode is installed within the elongated hexagonal faceplate photomultiplier tube so that the chords of the focus electrode base are parallel to the elongated hexagonal sides of the faceplate, and in service it has shown excellent collection efficiency and focusing characteristics.

DETAILED DESCRIPTION OF THE INVENTION

Figure 1:
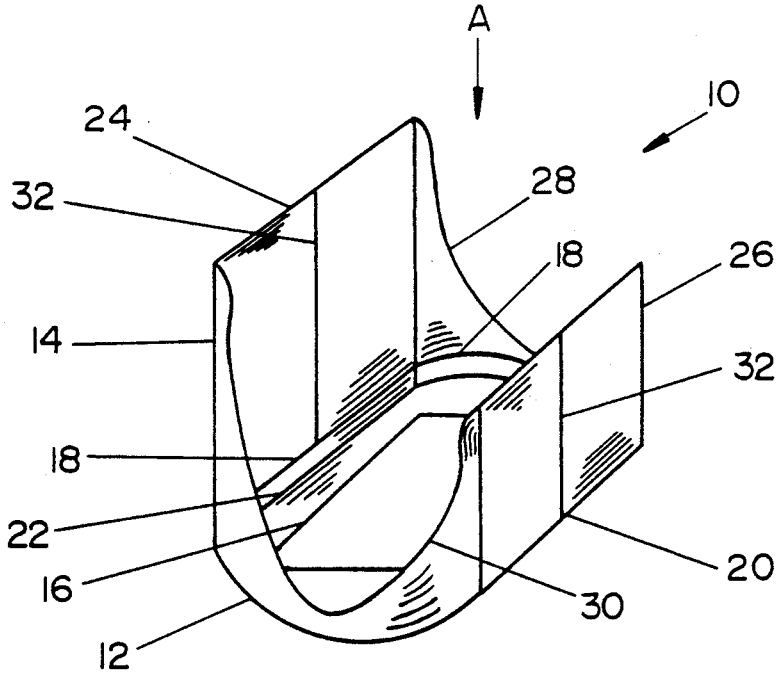
FIG. 1 is a perspective view of the preferred embodiment of the focus electrode of the invention.

The preferred embodiment of the focus electrode of the invention is shown in FIG. 1 in a perspective view in which focus electrode 10 is constructed of sheet metal with base 12 and side wall 14. As depicted in FIG. 1, the electrons would be moving in direction A from the photocathode (not shown) above focus electrode 10 to the first dynode (not shown) below focus electrode 10. The electrons pass through off-center aperture 16 as they move through base 12.

Base 12 is constructed as a shallow cup with a small lip 18 to which focus electrode side wall 14 is attached. Base 12 is essentially a circle with two parallel chords, 20 and 22, which cut off sections of the circle to form the perimeter of base 12.

Figure 2:
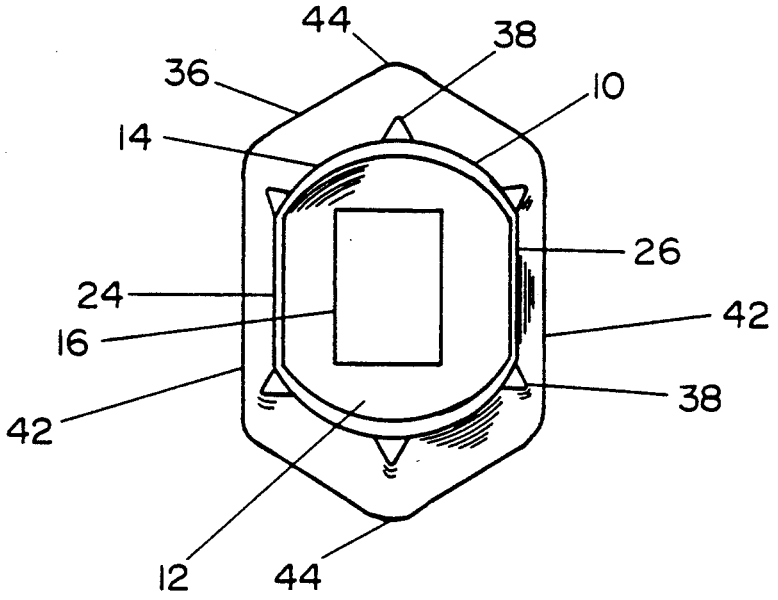
FIG. 2 is a plan view of the focus electrode of the invention with the outline of the elongated hexagonal faceplate shown in the relationship to the focus electrode which exists in an operating tube.

Aperture 16 is a rectangular through hole in base 12 with two of its sides parallel to chords 20 and 22, and, as best seen in FIG. 2, it is located off-center so that one of its edges is closer to chord 22 than the opposite edge is to chord 20.

Aperture 16 is located off-center because the small envelope of the photomultiplier tube into which focus electrode 10 is installed, a tube with an elongated hexagonal face plate, requires an off-center location for the several dynodes in order to fit all the necessary structure into the tube. It is this off-center dynode structure, along with the elongated hexagonal photocathode which necessitates the unique structure for focus electrode 10.

Side wall 14 of focus electrode 10 is a structure of varying height attached to the perimeter of base 12 and extending perpendicular to the plane of base 12 on one side of base 12. While the exact dimensions of side wall 14 will vary with the size of the tube into which focus electrode 10 is installed and can be determined by those practitioners skilled in the art of photomultiplier tube design, certain new and unusual general characteristics of the structure of side wall 14 have been discovered.

Side wall 14 is constructed with two straight sections, 24 and 26, above chords 22 and 20, respectively, of base 12, and with two curved sections, 28 and 30, joining straight sections 24 and 26 to form side wall 14. Side wall 14 is essentially continuous except for discontinuities such as joints 32 which are required when side wall 14 is constructed by conventional sheet metal techniques such as using two formed halves around the perimeter of base 12 to form side wall 14.

Each of straight sections 24 and 26 has a single height dimension across its entire length, but sections 24 and 26 have different heights. Straight section 24, which is nearer to an edge of aperture 16 than is straight section 26, is the higher of the two straight sections.

Curved sections 28 and 30 have varying heights over their lengths and are essentially mirror images of each other. They each vary in height from their highest points where they meet the ends of higher straight section 24, curve smoothly down to their lowest points, and then rise again to meet the ends of lower straight section 26. The lowest heights of curved sections 28 and 30 are located at the approximate center plane of the photomultiplier tube into which focus electrode 10 is installed.

FIG. 2 is a plan view of focus electrode 10 as it would be viewed from the faceplate end of a photomultiplier tube with the outline of elongated hexagonal faceplate 36 drawn to show the location of focus electrode 10 relative to faceplate 36. Bulb spacers 38, which are typically attached to base 12 are also seen in FIG. 2.

The particular orientation of focus electrode 10 with faceplate 36 is that straight sides 24 and 26 of focus electrode 10 are parallel to and equidistant from elongated sides 42 of hexagonal faceplate 36. Curved sides 28 and 30 of focus electrode 10 are also equidistant from ends 44 of faceplate 36.

Thus, although focus electrode 10 is essentially centered within the outline of faceplate 36, the asymmetrical structure of focus electrode 10 serves to collect and focus the electrons from a photocathode which is not circular and to deliver the electrons to a first dynode which is not centered within the tube.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the basic configuration of side wall 14 of focus electrode 10 could also be used in an elongated hexagonal photomultiplier tube which does not require the off-center dynode structure. Moreover, aperture 16 could also contain a semi-transparent mesh, as is well understood in the photomultiplier art. Furthermore, the straight sections of the sidewall need not necessarily be of uniform height, depending upon the shape and location of other components of the focusing structure.

What is claimed as new and for which Letters patent of the United States are desired to be secured is:

1. A focus electrode for a photomultiplier tube with an elongated hexagonal faceplate comprising:

a base comprising a planar structure with a through hole in the base through which electrons can pass; and a side wall which is an essentially continuous structure attached to the base and extending transverse to the base from one side of the base, the side wall comprising:

two straight sections, which are essentially parallel planes, each straight section attached to a part of the base; and two curved sections of varying heights interconnecting the straight sections.

2. The photomultiplier tube focus electrode of claim 1 wherein the focus electrode base is a partial circle with two parallel chords determining segments missing from the circle, and wherein each straight section is attached to one of the parts of the base which is a chord.

3. The photomultiplier tube focus electrode of claim 1 wherein each focus electrode side wall straight section has a single height dimension across its entire length.

4. The photomultiplier tube focus electrode of claim 1 wherein the through hole in the base of the focus electrode is rectangular in shape and two of its sides are parallel to the straight sections of the side wall.

5. The photomultiplier tube focus electrode of claim 1 wherein one straight section of the side wall of the focus electrode is of a greater height than the other.

6. The photomultiplier tube focus electrode of claim 1 wherein the heights of the ends of the two curved sections of the side wall of the focus electrode are the same as the heights of the straight sections which they adjoin.

7. The photomultiplier tube focus electrode of claim 1 wherein the heights of the curved sections of the side wall of the focus electrode vary so that each has a minimum height approximately at the center plane of the tube.

8. The photomultiplier tube focus electrode of claim 1 wherein the through hole in the base of the focus electrode is rectangular in shape and two of its sides are parallel to the straight sections of the side wall; one straight section of the side wall of the focus electrode is of a greater height than the other; and the through hole in the base is located off-center so that one of its edges is closer to the higher straight section than its opposite edge is to the lower straight section.

9. A focus electrode for a photomultiplier tube with an elongated hexagonal faceplate comprising:

a base comprising a planar structure which is a partial circle with two parallel chords determining segments missing from the circle, and a through hole in the base through which electrons can pass, the hole being rectangular in shape with two of its sides parallel to the chords of the base; and a side wall which is an essentially continuous structure attached to the perimeter of the base and extending transverse to the base from one side of the base, the side wall comprising:

two straight sections, one attached to each part of the base perimeter which is a chord of a circle, with each straight section having a single height dimension across its entire length and one straight section having a greater height than the other; and two curved sections interconnecting the straight sections, the curved sections being of varying heights so that the heights of their ends are the same as the heights of the straight sections which they adjoin and their heights are minimum at approximately the center plane of the tube.

10. The photomultiplier tube focus electrode of claim 9 wherein the through hole in the base is located off-center so that one of its edges is closer to the higher straight section than its opposite edge is to the lower straight section.

* * * * *